US006397541B1

(12) United States Patent
Brewer

(10) Patent No.: US 6,397,541 B1
(45) Date of Patent: Jun. 4, 2002

(54) DECORATIVE PANEL

(75) Inventor: Thomas D. Brewer, St. Louis, MO (US)

(73) Assignee: Parkton innovations, Inc., St. Louis, MO (US)

( * ) Notice: Subject to any disclaimer, the term of this patent is extended or adjusted under 35 U.S.C. 154(b) by 0 days.

(21) Appl. No.: 09/342,282

(22) Filed: Jun. 29, 1999

(51) Int. Cl.[7] ..... B44F 7/00

(52) U.S. Cl. ..... 52/316; 52/311.1; 52/455; 52/784.1

(58) Field of Search ..... 52/311.1, 316, 52/313, 314, 455, 784.1, 717.05, 717.04, 456

(56) References Cited

U.S. PATENT DOCUMENTS 4,811,538 A * 3/1989 Lehnert et al. ..... 52/455
5,293,726 A * 3/1994 Schick ..... 52/455
5,598,667 A * 2/1997 Dykes ..... 52/71
5,782,055 A * 7/1998 Crittenden ..... 52/784.1
5,887,402 A * 3/1999 Ruggie et al. ..... 52/455
6,079,183 A * 6/2000 Moyes ..... 52/784.1

* cited by examiner

*Primary Examiner*—Carl D. Friedman
*Assistant Examiner*—Jennifer I. Thissell
(74) *Attorney, Agent, or Firm*—Senniger, Powers, Leavitt & Roedel

(57) ABSTRACT

A panel for decorating a face of a conventional flat veneer plywood door to provide the door with a traditional rail-and stile appearance The panel has a decorative front surface, a back surface opposite the front surface adapted for attachment to the face of the door and a substantially uniform thickness separating the front and back surfaces. The front surface has a raised perimeter portion surrounding a central portion. The perimeter portion is spaced farther from the face of the door than the central portion when the back surface is attached to the face of the door. The back surface has an outer edge which contacts the face of the door when the back surface is attached to the face of the door.

18 Claims, 3 Drawing Sheets

DECORATIVE PANEL

BACKGROUND OF THE INVENTION

The present invention relates generally to a panel and, more particularly, to a panel for decorating a face of a conventional flat veneer plywood door to provide the door with a traditional rail-and-stile appearance.

One conventional method of making interior residential doors is to assemble a frame of horizontal rails and vertical stiles around one or more wooden panels. Although this method provides an attractive door having an appearance somewhat similar to that shown in FIG. 1, this type of door tends to sag, shift and/or warp after a period of many years and is costly to make because of the labor required to assemble it. A less costly and more geometrically stable method of making an interior door is to sandwich a frame between thin sheets of plywood commonly referred to as luan having veneer on their respective exterior surfaces. Although the plywood prevents the frame from sagging, the flat veneer surfaces of these doors are less attractive than traditional rail-and-stile doors to many homeowners. To overcome this deficiency, an alternate construction has been developed in which sheets of material such as pressed wood molded to have a rail-and-stile appearance are attached to a frame instead of the plywood. These molded doors have an appealing appearance and are less susceptible to sagging and shifting than rail-and-stile doors. However, replacing existing flat veneer plywood doors with new molded doors is prohibitively expensive for many homeowners.

SUMMARY OF THE INVENTION

Among the several objects and features of the present invention may be noted the provision of a panel and method which may be used to retrofit an existing door to have a rail-and-stile appearance; the provision of such a panel and method which may be used by unskilled labor; the provision of such a panel and method which provide an attractive door; and the provision of such a panel and method which produce geometrically stabile doors.

Briefly, apparatus of this invention is a panel for decorating a face of a conventional flat veneer plywood door to provide the door with a traditional rail-and-stile appearance. The panel has a decorative front surface, a back surface opposite the front surface adapted for attachment to the face of the door and a substantially uniform thickness separating the front and back surfaces. The front surface has a raised perimeter portion surrounding a central portion. In addition, the perimeter portion is spaced farther from the face of the door than the central portion when the back surface is attached to the face of the door. Further, the back surface has an outer edge which contacts the face of the door when the back surface is attached to the face of the door.

In another aspect, the invention includes a molded plastic panel for decorating a face of a conventional flat veneer plywood door. The panel has a front surface and a back surface opposite the front surface. The front surface includes a central portion having an appearance of a separate panel and a perimeter portion surrounding the central portion having an appearance of a raised molding. The back surface includes an adhesive substance for applying the panel to the face of the conventional flat veneer plywood door.

In yet another aspect, the present invention includes a method of applying a panel to a face of a conventional flat veneer plywood door to provide the door with a traditional rail-and-stile appearance. The method comprises the steps of selecting a desired position on the face of the door at which to apply the panel, and bonding the panel to the position on the face of the door with an adhesive. The method further includes the step of applying a bead of caulk around the panel to cover a parting line between the panel and the door.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
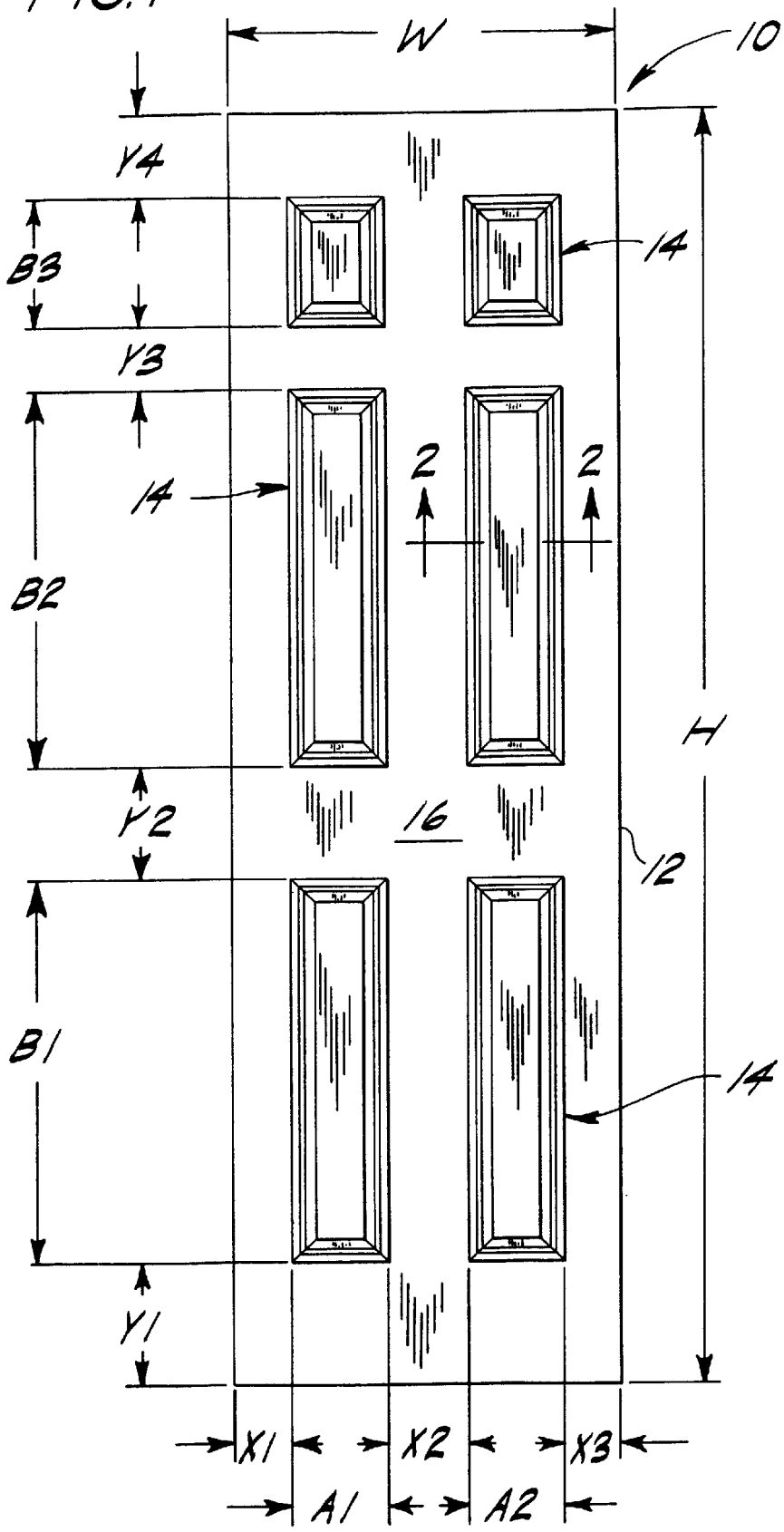
FIG. 1 is a front elevation of six panels of the present invention applied to a flat surface of a door.

Referring now to the drawings and in particular to FIG. 1, a door assembly is designated in its entirety by the reference numeral 10. The door assembly 10 includes a conventional flat veneer plywood door 12 having six panels, each generally designated by 14, decorating a face 16 of the door to provide the door with a traditional rail-and-stile appearance. Because the door 12 has a conventional construction which is well known by those skilled in the art, it will not be described in further detail herein. Although the panels 14 have differing dimensions from one another to give the assembly 12 a more visually appealing appearance, each of the panels has an identical construction in the most preferred embodiment. Although the panels 14 may be made of other materials without departing from the scope of the present invention, the panels of the preferred embodiment are made of a moldable plastic such as a high impact polystyrene.

Figure 2:
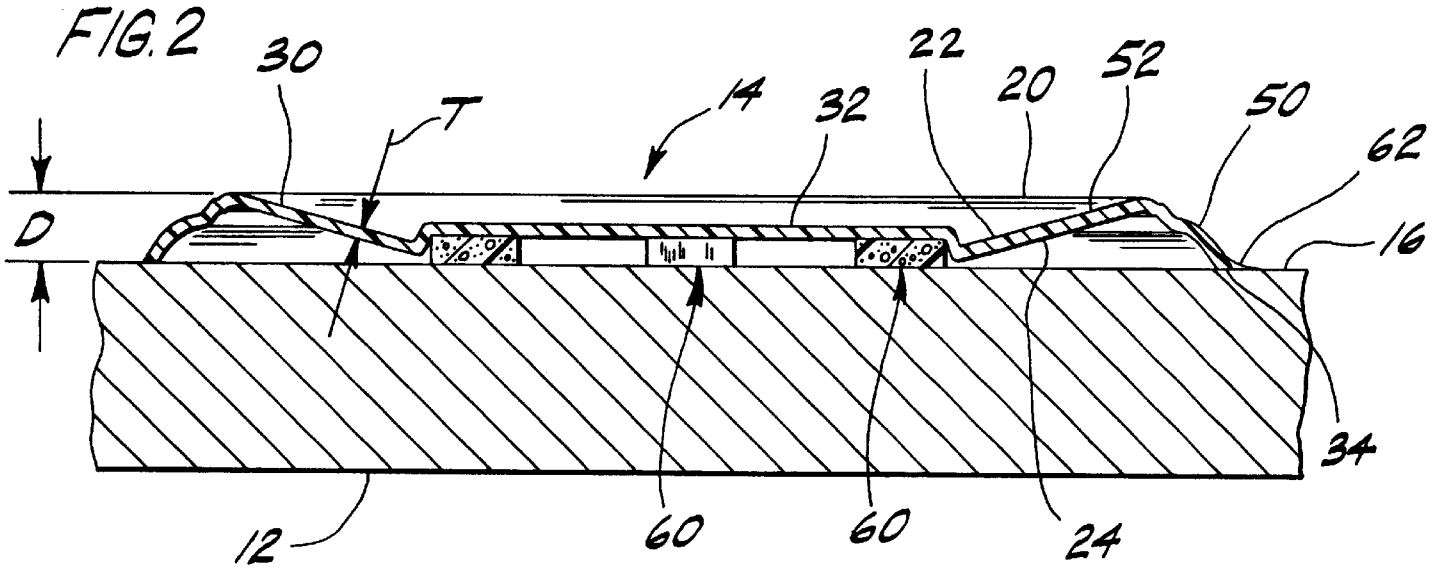
FIG. 2 is a section taken in the plane of line 2–2 of FIG. 1.

As illustrated in FIG. 2, each panel 14 comprises a thin sheet of material 20 which is molded to the desired shape by a conventional process such as vacuum forming. The resulting panel 14 has a decorative front surface 22 and a back surface 24 opposite the front surface adapted for attachment to the face 16 of the door. Further, the panel 14 has a substantially uniform thickness T separating the front and back surfaces 22, 24, respectively. Although the panel 14 may have other thicknesses without departing from the scope of the present invention, the panel of the preferred embodiment has a thickness of about 0.03 inches. Using thicknesses greater than the preferred thickness tends to cause the shape of the panel to lose definition and using thicknesses less than the preferred thickness tends to produce panels which are too flexible.

Figure 3:
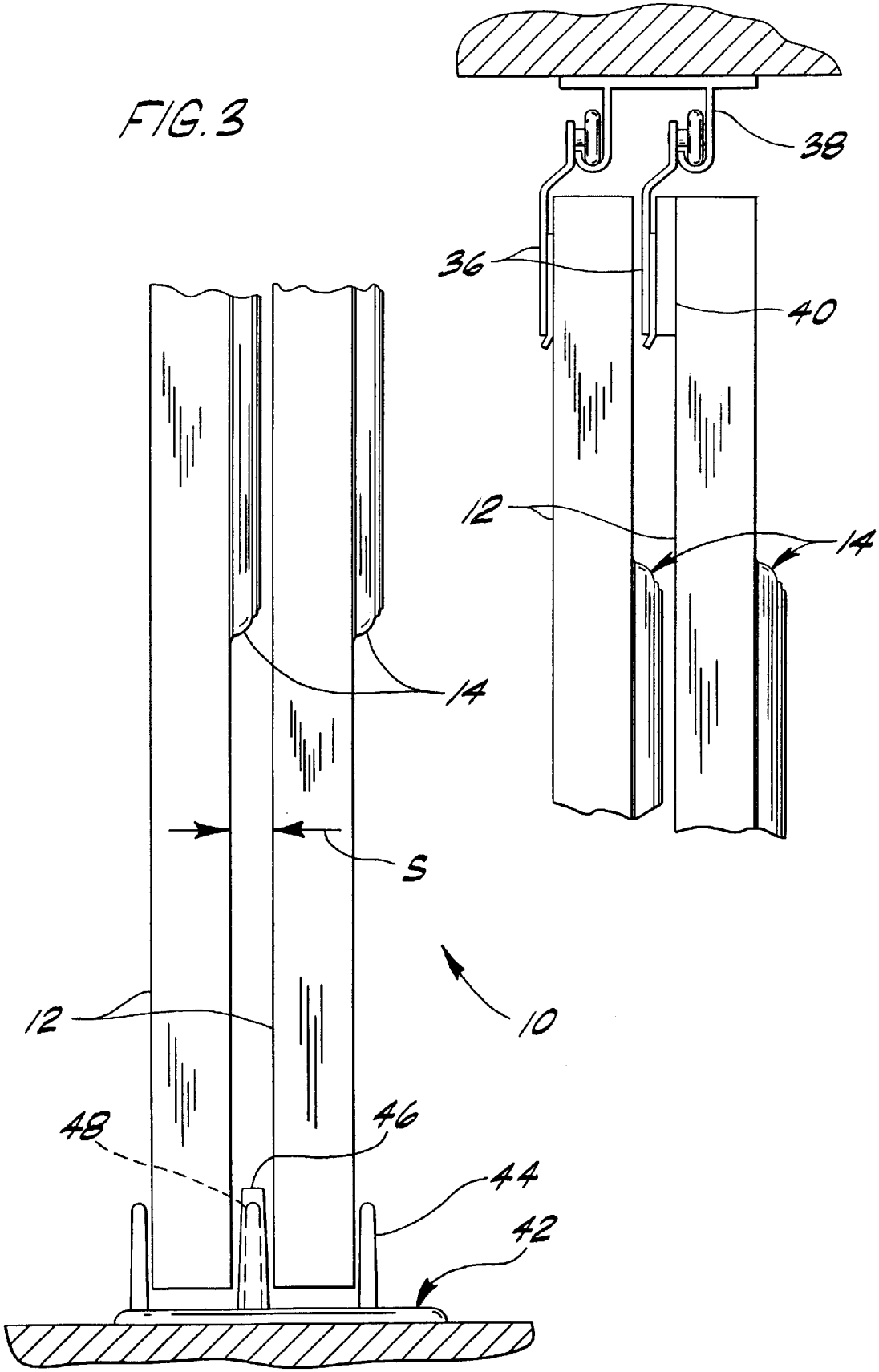
FIG. 3 is a side elevation of adjacent sliding doors having a shim and spacer installed.

The front surface 22 has a raised perimeter portion 30 surrounding a generally planar central portion 32. The central portion 32 has an appearance of a separate panel, and the perimeter portion 30 has an appearance of a raised molding. As shown in FIG. 2, the perimeter portion 30 is spaced farther from the face 16 of the door 12 than the central portion 32 when the back surface 24 is attached to the face of the door as will be explained in greater detail below. Although the raised perimeter portion 30 may be spaced from the face 16 of the door 12 by other distances without departing from the scope of the present invention, the perimeter portion of the preferred embodiment is spaced by a distance D of less than about ⅜ inches and, more preferably, by a distance of less than about ¼ inches. These distances D, and in particular the smaller distance, allow the panels 14 to be applied to a sliding door having a closely spaced adjacent door without the panel interfering with the adjacent door when the doors are opened and/or closed. As illustrated in FIG. 3, conventional roller brackets 36 which suspend the sliding doors 12 from a track 38 may be modified, replaced or repositioned (e.g., with a shim 40) to increase the space S between the doors to provide clearance for the panels 14 if necessary. Further, a guide, generally designated by 42, at the bottom of the sliding door 12 may be adjusted by spreading the outer posts 44 to allow the spacing S between the doors to increase, and a spacer 46 may be installed over a center post 48 of the guide between the doors to ensure the spacing is maintained.

As illustrated in FIG. 2, the perimeter portion 30 of the front surface 22 includes an outer rounded portion 50 and a transition portion 52 extending between the outer rounded portion and the central portion 32. The transition portion 52 includes at least four generally planar segments surrounding the central portion which gently taper from the rounded portion 50 toward the door 12. The rounded portion 50 and the tapered transition portion 52 create an illusion that the central panel portion 32 is recessed below the face 16 of the door 14. Thus, the panels 12 provide the door assembly 10 with a traditional rail-and-stile appearance.

The back surface 24 includes an adhesive substance 60 for applying the panel 14 to the face 16 of the conventional flat veneer plywood door 12. Although other substances may be used without departing from the scope of the present invention, in the preferred embodiment the adhesive substance 60 is a two-sided tape having a foam core. One such tape is a two-sided, ¼ inch thick, medium density urethane foam tape available from Minnesota Mining and Manufacturing Company of Saint Paul, Minn. Although the tape may be applied in strips or as one wide strip, in one preferred embodiment the tape is applied as spaced squares (e.g., ¾"×¾" squares). The outer edge 34 of the back surface 24 of the panel 14 contacts the face 16 of the door 12 when the back surface is attached to the face of the door. The interface between the outer edge 34 and the face 16 of the door 12 can be obscured with caulk 62 or the like to hide any gap between the panel 14 and the door. The caulk 62 also supports the panel 14 and prevents it from flexing.

Figure 4:
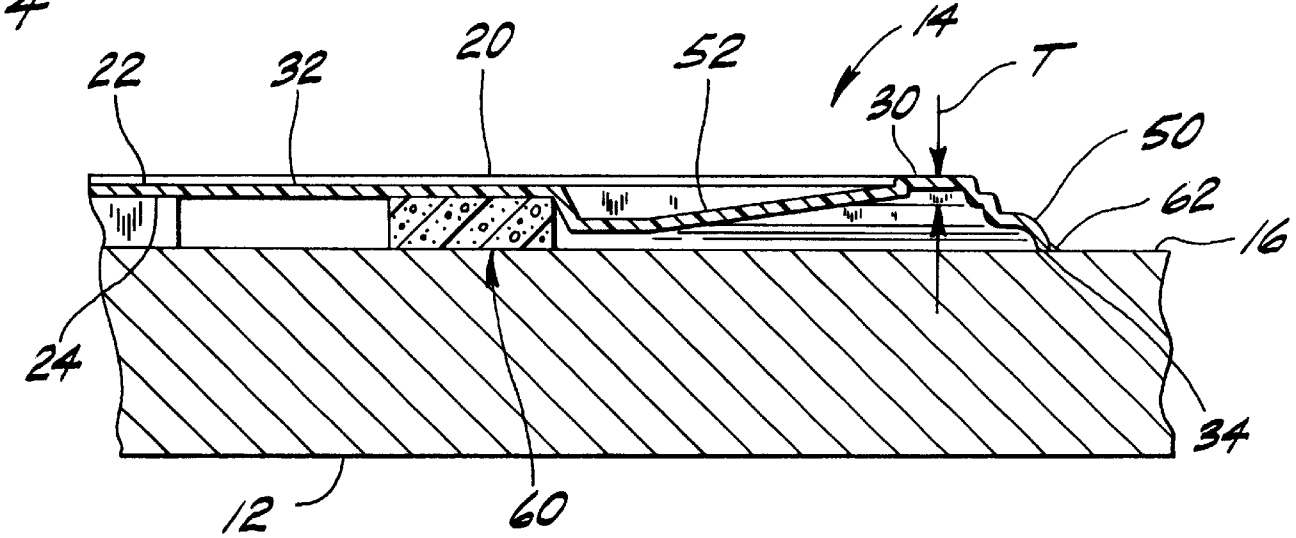
FIG. 4 is a section similar to FIG. 2 but showing an alternate embodiment.

FIG. 4 shows an alternate embodiment of the present invention which includes a panel 14 having a slightly different shape than the shape of the panel shown in FIG. 2. However, the construction of the alternate embodiment shown in FIG. 4 is identical to the construction of the embodiment shown in FIG. 2.

Panels 14 of the present invention are applied to a face 16 of a conventional flat veneer plywood door 12 by first selecting a desired position on the face of the door at which to apply the panel. The desired position may be determined by measuring in from the edges of the door 12 some predetermined distance. Alternately, a template (not shown) may be used to determine the desired positions.

Although the dimensions and positions may vary without departing from the scope of the present invention, for a standard door having a preferred height H (FIG. 1) of about 80 inches, the middle and lower row of panels have preferred heights B1 and B2 of about 24 inches each, and the upper row of panels has a preferred height B3 of about 8 inches. In addition, the preferred distance Y1 between the lowest panels and the bottom edge of the door is about 8 inches, the preferred distance Y2 between the lower two rows of panels is about 7 inches, the preferred distance Y3 between the upper two rows of panels is about 4 inches, and the preferred distance Y4 between the upper row of panels and the upper edge of the door is about 5 inches. Table 1 shows the approximate horizontal dimensions of panels of the most preferred embodiment and their most preferred horizontal positions on the face of various standard size doors.

TABLE 1

| W nominal (inches) | A1 & A2 (inches) | X1 & X3 (inches) | X2 (inches) |
|---|---|---|---|
| 18 | 4.875 | 3.0 | 2.0 |
| 20 | 5.875 | 3.0 | 2.0 |
| 24 | 5.875 | 4.25 | 3.5 |
| 28 | 6.875 | 5.0 | 4.0 |
| 30 | 7.875 | 5.0 | 4.0 |
| 32 | 8.875 | 5.0 | 4.0 |
| 36 | 10.875 | 5.0 | 4.0 |

Once the desired position is determined, the panel 14 is bonded to the position on the face 16 of the door 12 with the adhesive substance 60. In the most preferred embodiment, the bonding step is accomplished by removing masking (not shown) from the two-sided tape to expose its adhesive surface and pressing the panel 14 against the door 12 to bond the panel in position. A bead of caulk 62 is applied around the panel 14 to cover a gap or parting line between the panel and the door 12. Once the caulk 62 is applied, the panel 14, the face 16 of the door 12 and the caulk may be painted a desired color.

Alternatively, the panel 14 may be colored during manufacture so it matches common door colors. Further, the panel 14 may be molded so it is grained to have the appearance of wood. Still further, the front surface 22 of the panel 14 may be frosted or otherwise textured to increase the surface roughness for improving the adhesion of paint. In addition, the panels 14 may have other shapes such as circular or octagonal without departing from the scope of the present invention.

As will be appreciated by those of ordinary skill in the art, the panels described above are inexpensive compared to traditional rail-and-stile doors. Further, the method of installation is simple so an inexperienced laborer or homeowner can install the doors without difficulty. Still further, the panels of the present invention permit existing doors to be retrofitted or new doors to be modified prior to installation.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. In combination, a door having at least one face, and panels for decorating the face of the door to provide the door with a traditional rail-and-stile appearance, the panels having a decorative front surface, a back surface opposite the front surface attached to the face of the door and a substantially uniform thickness separating said front and back surfaces, the front surface having a raised perimeter portion surrounding a central portion, said perimeter portion being spaced farther from the face of the door than the central portion when the back surface is attached to the face of the door, the back surface having an outer edge which contacts the face of the door when the back surface is attached to the face of the door.

2. A combination as set forth in claim 1 wherein the raised perimeter portion is spaced from the face of the door when the back surface is attached to the face of the door by a distance which is less than about ⅜ inches.

3. A combination as set forth in claim 2 wherein the raised perimeter portion is spaced from the face of the door when the back surface is attached to the face of the door by a distance which is no more than about ¼ inches.

4. A combination as set forth in claim 1 wherein the central portion is generally planar.

5. A combination as set forth in claim 4 wherein the perimeter portion of the front surface includes an outer rounded portion and a transition portion extending between the outer rounded portion and the central portion.

6. A combination as set forth in claim 5 wherein the transition portion includes at least four generally planar segments surrounding the central portion.

7. A combination as set forth in claim 1 wherein the panels have an overall height less than that of the face of the door and an overall width less than that of the face of the door so that portions of the door face are exposed when the panels are attached thereto.

8. In combination, a door having at least one face, and molded plastic panels for decorating the face of the door to provide the door with a traditional rail-and-stile appearance, the panels having a front surface and a back surface opposite the front surface, the front surface including a central portion having an appearance of a separate panel and a perimeter portion surrounding the central portion having an appearance of a raised molding, the back surface including an adhesive substance for applying the panels to the face of the door.

9. A combination as set forth in claim 8 wherein the adhesive substance includes a two-sided tape.

10. A combination as set forth in claim 9 wherein the two-sided tape includes a layer of foam.

11. A combination as set forth in claim 8 wherein the perimeter portion is spaced from the face of the door when the back surface is attached to the face of the door by a distance which is less than about ⅜ inches.

12. A combination as set forth in claim 11 wherein the perimeter portion is spaced from the face of the door when the back surface is attached to the face of the door by a distance which is no more than about ¼ inches.

13. A combination as set forth in claim 8 wherein the central portion is generally planar.

14. A combination as set forth in claim 13 wherein the perimeter portion of the front surface includes an outer rounded portion and a transition portion extending between the outer rounded portion and the central portion.

15. A combination as set forth in claim 14 wherein the transition portion includes at least four generally planar segments surrounding the central portion.

16. A combination as set forth in claim 8 wherein the panels have an overall height less than that of the face of the door and an overall width less than that of the face of the door so that portions of the door face are exposed when the panels are attached thereto.

17. A method of applying a panel to a face of a conventional flat veneer plywood door to provide the door with a traditional rail-and-stile appearance, the method comprising the steps of:

selecting a desired position on the face of the door at which to apply the panel;

bonding the panel to the position on the face of the door with an adhesive; and applying a bead of caulk around the panel to cover a parting line between the panel and the door.

18. A method as set forth in claim 17 further comprising the step of painting the panel, the face of the door and the bead of caulk around the panel to give the panel, face and bead a uniform coloration.

* * * * *